United States Patent [19]

Maruyama et al.

[11] Patent Number: 4,868,065

[45] Date of Patent: Sep. 19, 1989

[54] ALLOY TOOL OF HARD METAL

[75] Inventors: Masao Maruyama; Atsushi Seki; Yoshihiro Minato, all of Itami, Japan

[73] Assignee: Sumitomo Electric Industries, Ltd., Osaka, Japan

[21] Appl. No.: 111,406

[22] Filed: Oct. 20, 1987

[30] Foreign Application Priority Data

Nov. 12, 1986 [JP] Japan ..... 61-268887

[51] Int. Cl.[4] ..... G22F 3/00

[52] U.S. Cl. ..... 428/547; 419/6; 419/13; 419/15; 419/17; 419/18; 419/49; 428/552; 428/565

[58] Field of Search ..... 428/565, 547, 552; 419/6, 13, 15, 17, 18, 49

[56] References Cited

U.S. PATENT DOCUMENTS

| | | | |
|---|---|---|---|
| 3,665,585 | 5/1972 | Dunn et al. | 419/6 |
| 3,999,954 | 12/1976 | Kolaska et al. | 419/15 |
| 4,082,559 | 4/1978 | Mishuku et al. | 419/8 |
| 4,137,106 | 1/1979 | Doi et al. | 419/8 |
| 4,198,233 | 4/1980 | Frehn | 419/15 |
| 4,359,335 | 11/1982 | Garner | 419/6 |
| 4,398,952 | 8/1983 | Drake | 419/17 |
| 4,602,952 | 7/1986 | Greene et al. | 419/6 |
| 4,602,956 | 7/1986 | Partlow et al. | 419/6 |
| 4,610,931 | 9/1986 | Nemeth et al. | 419/14 |

FOREIGN PATENT DOCUMENTS

| | | | |
|---|---|---|---|
| 1026958 | 7/1983 | U.S.S.R. | 419/6 |

OTHER PUBLICATIONS

Schwarzkopf et al, *Cemented Carbides,* 1960, pp. 138 and 159.

*Primary Examiner*—Lechert, Jr. Stephen J.
*Attorney, Agent, or Firm*—W. G. Fasse; D. H. Kane, Jr.

[57] ABSTRACT

An alloy tool of hard metal has a working part and a non-working part. The working part is made of a hard metal containing carbide of at least a metal selected from a group of elements belonging to the groups IVa, Va and VIa of the periodic table as a basis metal of the hard phase and an iron family metal as a basis metal of the binder phase. The working part includes a region for working a work piece. The non-working part is made of a hard metal containing carbide of at least a metal selected from a group of elements belonging to the groups IVa, Va and VIa of the periodic table as a basis metal of the hard phase of the non-working part and of an iron family metal as a basis metal of the binder phase of the non-working part. A diffused junction between the working and non-working parts bonds the two parts together. The non-working part has a higher thermal expansion coefficient than the working part, whereby the non-working part, through the diffused junction, applies a residual compressive stress to the working part for an improved tool strength.

11 Claims, 1 Drawing Sheet

ALLOY TOOL OF HARD METAL

BACKGROUND OF THE INVENTION

1. Field of the Invention

The present invention relates to an alloy tool of hard metal employed for machining work, and more particularly, it relates to a cutter etc. such as a cutting tool, drill or a die made of cemented carbide.

2. Description of the Prior Art

Cemented carbide is generally employed to make cutting tools including drill bits. Such cemented carbide is superior in hardness, abrasion resistance etc. to high speed steel, whereas the same is inferior in toughness. Therefore, improvements in the strength of cemented carbide are desirable.

In hard metal represented by such cemented carbide, the tensile strength is generally smaller than the compressive strength. Therefore, the strength of a tool itself corresponds to its tensile strength. Thus, the tool itself cannot attain considerable strength since its tensile strength is inferior although the tool has a high compressive strength.

SUMMARY OF THE INVENTION

An object of the present invention is to improve or rather reduce the imbalance between the compressive strength and the tensile strength of hard metal and provide an alloy tool of hard metal which is improved in strength.

An alloy tool of hard metal according to the present invention comprises a working part and a non-working part of hard metal. The hard metal of the working part contains carbide of at least a metal selected from a group of elements from the groups IVa, Va and VIa of the periodic table, as a basis metal of the hard phase and an iron family metal as a basis metal of the binder phase. The machining part includes a region for working a work piece. The non-working part of hard metal contains carbide of at least a metal selected from a group of elements from the groups IVa, Va and VIa of the periodic table as a basis metal of the hard phase and an iron family metal as a basis metal of the binder phase. The non-working part has a higher thermal expansion coefficient than the working part. The non-working part is connected to the working part by a diffused junction for applying residual compressive stress to the working part.

After the diffused junction is established, both the working part and the non-working part are lowered in temperature to thermally contract. Since the non-working part has a larger coefficient of contraction than the working part, a compressive stress is applied to the working part and remains in the same. When the compressive stress thus remains in the working part, its tensile strength is improved by the residual compressive stress. Thus, according to the present invention, the imbalance between the compressive strength and the tensile strength of hard metal has been reduced to improve the toughness of the tool and increase the life thereof. Further, for usage allowing a rather inferior strength, low-priced materials of smaller strength than conventional materials can be employed to attain the required strength, which is substantially identical to that of the conventional tool. Therefore, the cost can be reduced by application of the present invention.

These and other objects, features, aspects and advantages of the present invention will become more apparent from the following detailed description of the present invention when taken in conjunction with the accompanying drawings.

DETAILED DESCRIPTION OF PREFERRED EXAMPLE EMBODIMENTS AND OF THE MEST MODE OF THE INVENTION

In the present invention, carbide is employed as a basis metal for the hard phase in a working and in a non-working part. The carbide is prepared by using at least a metal selected from a group of elements belonging to the groups IVa, Va and VIa of the periodic table such as Ti, Zr, Hf, V, Nb, Ta, Cr, Mo and W. Within these, W, Ti and Ta are generally employed particularly as materials for carbides of hard metals.

The basis metal for the binder phase is an iron family metal such as Co, Ni or Fe.

In addition to the carbide, the hard phase may include nitride and/or carbo-nitride of at least a metal selected from a group of elements belonging to the groups IVa, Va and VIa of the periodic table.

The hard metal for the non-working part may be higher in thermal expansion coefficient than that for the working part. In consideration a diffused junction between the working part and the non-working part, however, the hard metal of the non-working part is preferably as similar as possible to that of the working part of a tool according to the invention.

In order that the hard metal of the non-working part has a higher thermal expansion coefficient than that of the working part, for example, the amount of the binder phase of the non-working part may be larger than the binder phase of the working part or the non-working part may contain a larger amount of components of large thermal expansion coefficients. Since TiC has a higher thermal expansion coefficient than WC, the non-working part can be made to have a higher thermal expansion coefficient than the working part, by containing TiC in a larger amount than the working part when WC and TiC are contained in the carbide of the hard phase.

The diffused junction in the present invention is preferably formed by sintering the diffused junction or by hot isostatic pressing, hereinafter referred to as HIP, the diffused junction in respective manufacturing steps. The sintering and the HIP may be combined to form the diffused junction, for example the HIP may follow the sintering or sintering and HIP may be performed simultaneously. For example, a sintered non-working part may be brought into close contact with an unsintered working part to sinter the working part in this state, and to thereafter perform the HIP forming. Alternatively, a sintered non-working part may be brought into close contact with a sintered working part to re-sinter the same, to thereafter perform the HIP forming.

Figure 1:
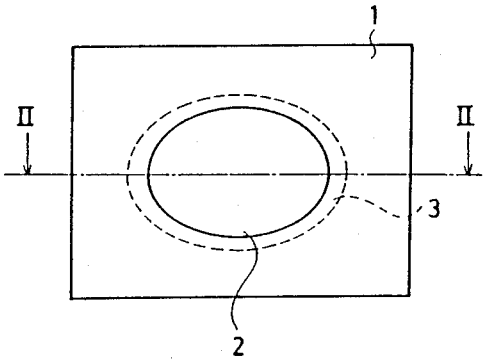
FIG. 1 is a plan view showing a tool tip according to an embodiment of the present invention.
Figure 2:
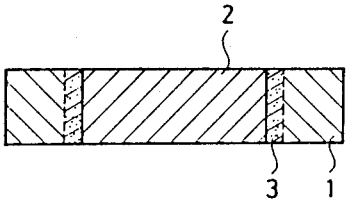
FIG. 2 is a sectional view taken along the line II—II in FIG. 1.

The present invention will now be described with reference to the drawings. FIGS. 1 and 2 illustrate a tool tip according to the present invention. In the tip as shown in FIGS. 1 and 2, a diffused junction 3 is so formed that a working part 1 encircles a non-working part 2, whereby the diffused junction part 3 is provided in a boundary region between parts 1 and 2. After the diffused junction 3 has been formed, the non-working part 2 contracts at a larger rate than the working part 1. Due to such contraction of the non-working part 2, the working part 1 contracts at a rate larger than that caused by its own coefficient of contraction, whereby compressive stress remains in its interior.

Figure 3:
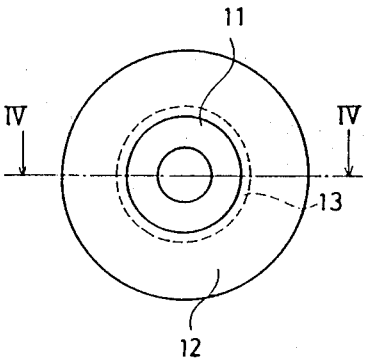
FIG. 3 is a plan view showing a die according to another embodiment of the present invention.
Figure 4:
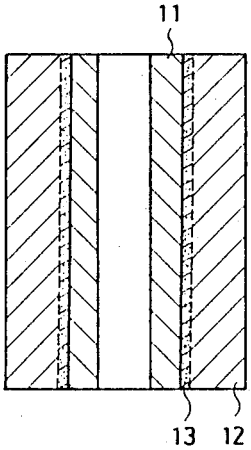
FIG. 4 is a sectional view taken along the line IV—IV in FIG. 3.

In this embodiment of FIGS. 3 and 4*a* diffused junction 13 is formed between a working part 11 and a non-working part 12 encircling the cylindrical working part 11. The diffused junction 13 is provided in the boundary region between the two parts. Even if the non-working part 12 is thus provided in the exterior of the working part 11, the non-working part 12 contracts due to its larger coefficient of contraction after the diffused junction has been established, whereby compressive stress remains in the working part 11. Such a structure is applied to make a drawing die or a plastic working die, for example.

The difference between the thermal expansion coefficients of the hard metal of the working part and of the non-working part is preferably over $1\times10^{-7}$/°C. up to $3\times10^{-6}$/°C., and more preferably, over $0.4\times10^{-6}$/°C. up to $1.0\times10^{-6}$/°C.

Sufficient compressive stress cannot remain in the working part if the difference between the thermal expansion coefficients is less than $1\times10^{-7}$/°C., while size distortion caused by deformation or the like is increased or cracking may take place during sintering if the difference in thermal expansion coefficient exceeds $3.0\times10^{-6}$/°C.

EXAMPLES

Tips (sample shape: SNG432 Japanese Industrial Standard; hereinafter referred to as JIS) of the configuration as shown in FIGS. 1 and 2 were prepared. Materials for making the working and non-working parts were prepared as shown in the following Examples 1 to 4 and reference examples 1 to 4, to be bonded to each other by a diffused junction. The diffused junction was formed by re-sintering sintered working and non-working parts, followed by HIP forming.

Each of the tips thus obtained was subjected to a residual stress measuring test and/or a rupture strength measuring test and/or a milling test.

As to the residual stress, such stress applied to WC crystal lattices was measured by X-ray diffraction methods.

The rupture strength was measured in accordance with CIS-026-1983.

The milling test was performed by cutting SCM3 (JIS G4105; hardness Hs40) with a peripheral speed of 150 m/min., a feed advance of 0.2 mm/r and a depth of cut of 2 mm, and measuring the time to thermal crack initiation.

Table 1 shows the results of the measurements of the example of the invention and of the reference examples.

EXAMPLE 1

A tip was prepared by employing WC-Co cemented carbide (Co: 10 wt.%) as the material for making the working part and WC-Co cemented carbide (Co: 15wt.%) as the material for making the non-working part.

REFERENCE EXAMPLE 1

A tip was prepared similarly to Example 1, except that the non-working part was made of WC-Co cemented carbide (Co: 10 wt.%) identically to the working part.

EXAMPLE 2

A tip was prepared by employing cemented carbide of WC-10 wt.% TiC-10 wt.% TaC-10 wt.% Co as the material for making the working part and cemented carbide of WC-10 wt.% TiC-10 wt.% TaC-13 wt.% Co as the material for making the non-working part.

REFERENCE EXAMPLE 2

A tip was prepared similarly to Example 2, except that the non-working part was made of cemented carbide of WC-10 wt.% TiC-10 wt.% TaC-10 wt.% Co identically to the working part.

EXAMPLE 3

A tip was prepared by employing cemented carbide of WC-5 wt.% TiC-5 wt.% TaC-10 wt.% Co as the material for making the working part and cemented carbide of WC-20 wt.% TiC-5 wt.% TaC-10 wt.% Co as the material for making the non-working part.

REFERENCE EXAMPLE 3

A tip was prepared similarly to Example 3 except that the non-working part was prepared of cemented carbide of WC-5 wt.% TiC-5 wt.% TaC-10 wt.% Co, identically to the working part.

EXAMPLE 4

A tip was prepared by employing cemented carbide of WC-3 wt.% TiC-2 wt.% TiN-5 wt.% TaC-8 wt.% Co-2 wt.% Ni as the material for making the working part and cemented carbide of WC-15 wt.% TiC-5 wt.% TiCN-5 wt.% TaC-8 wt.% Co-2 wt.% Ni as the material for the non-working part.

REFERENCE EXAMPLE 4

A tip was prepared similarly to Example 4, except that the non-working part was made of cemented carbide of WC-3 wt.% TiC-2 wt.% TiN-5 wt.% TaC-8 wt.% Co-2 wt.% Ni identically to the working part.

As is clear from Table 1, all of Examples 1 to 4 according to the present invention were superior in rupture strength and cutting performance to the reference examples.

TABLE 1

| | | Hard Metal | | Difference in | | | |
|---|---|---|---|---|---|---|---|
| | | Composition | Thermal Expansion Coefficient (°C.$^{-1}$) | Thermal Expansion Coefficient between Working Part and Non-Working Part | Residual Stress (kg/mm$^2$) | Rupture Strength (kg/mm$^2$) | Milling Test |
| Example 1 | Working Part | WC—10% Co | $5.0 \times 10^{-6}$ | $0.4 \times 10^{-6}$ | 100 | 320 | — |
| | Non-Working Part | WC—15% Co | $5.4 \times 10^{-6}$ | | | | |
| Reference | Working Part | WC—10% Co | $5.0 \times 10^{-6}$ | 0 | 10 | 250 | — |
| Example 1 | Non-Working Part | WC—10% Co | $5.0 \times 10^{-6}$ | | | | |
| Example 2 | Working Part | WC—10% TiC—10% TaC—10% Co | $5.2 \times 10^{-6}$ | $0.4 \times 10^{-6}$ | 150 | — | 15 min. |
| | Non-Working Part | WC—10% TiC—10% TaC—13% Co | $5.6 \times 10^{-6}$ | | | | |
| Reference | Working Part | WC—10% TiC—10% TaC—10% Co | $5.2 \times 10^{-6}$ | 0 | 20 | — | 10 min. |
| Example 2 | Non-Working Part | WC—10% TiC—10% TaC—10% Co | $5.2 \times 10^{-6}$ | | | | |
| Example 3 | Working Part | WC—5% TiC—5% TaC—10% Co | $5.1 \times 10^{-6}$ | $0.7 \times 10^{-6}$ | 90 | 270 | 10 min. |
| | Non-Working Part | WC—20% TiC—5% TaC—10% Co | $5.8 \times 10^{-6}$ | | | | |
| Reference | Working Part | WC—5% TiC—5% TaC—10% Co | $5.1 \times 10^{-6}$ | 0 | 8 | 230 | 5 min. |
| Example 3 | Non-Working Part | WC—5% TiC—5% TaC—10% Co | $5.1 \times 10^{-6}$ | | | | |
| Example 4 | Working Part | WC—3% TiC—2% TiN—5% TaC—8% Co—2% Ni | $5.1 \times 10^{-6}$ | $0.7 \times 10^{-6}$ | 90 | 270 | 10 min. |
| | Non-Working Part | WC—15% TiC—5% TiCN—5% TaC—8% Co—2% Ni | $5.8 \times 10^{-6}$ | | | | |
| Reference | Working Part | WC—3% TiC—2% TiN—5% TaC—8% Co—2% Ni | $5.1 \times 10^{-6}$ | 0 | 8 | 230 | 5 min. |
| Example 4 | Non-Working Part | WC—3% TiC—2% TiN—5% TaC—8% Co—2% Ni | $5.1 \times 10^{-6}$ | | | | |

What is claimed is:

1. An alloy tool of hard metal comprising: a working part having a hard phase and a binder phase, said hard phase being made of a hard metal containing carbide of at least a metal selected from elements of groups IVa, Va and VIa of the periodic table as a basis metal of said hard phase, said binder phase being made of an iron family metal as basis metal of said binder phase, said working part including a region for working a work piece; a non-working part having a further hard phase and a further binder phase, said further hard phase being made of a hard metal containing carbide of at least a metal selected from a group of elements belonging to the groups IVa, Va and VIA of the periodic table as basis metal of said further hard phase, said further binder phase being made of an iron family metal as a basis metal of said further binder phase, a diffused junction between said working part and said non-working part for bonding said parts to each other, said non-working part having a higher thermal expansion coefficient than said working part such that said thermal expansion coefficients of said working part and of said non-working part differ from each other within a range of $1\times10^{-7}$/°C. to $3\times10^{-6}$/°C. for applying a residual compressive stress to said working part by said non-working part through said diffused junction.

2. The alloy tool of hard metal in accordance with claim 1, wherein said hard metal of said non-working part contains a larger amount of binder phase than said hard metal of said working part.

3. The alloy tool of hard metal in accordance with claim 1, wherein hard phases of said hard metal of said working part and of said non-working part contain tungsten carbide.

4. The alloy tool of hard metal in accordance with claim 3, wherein both said hard phases further contain titanium carbide.

5. The alloy tool of hard metal in accordance with claim 4, wherein said hard phase of said non-working part contains a larger amount of titanium carbide than said hard phase of said working part.

6. The alloy tool of hard metal in accordance with claim 1, wherein both said hard phases of said hard metal of said working part and of said non-working part further contain nitride and/or carbo-nitride of at least a metal selected from a group of elements belonging to the groups IVa, Va and VIa of the periodic table.

7. The alloy tool of hard metal in accordance with claim 6, wherein said nitride and/or said carbo-nitride is titanium nitride and/or titanium carbo-nitride.

8. The alloy tool of hard metal in accordance with claim 1, wherein said diffused junction is located so that said working part encircles said non-working part.

9. The alloy tool of hard metal in accordance with claim 1, wherein said diffused junction is located so that said non-working part encircles said working part.

10. The alloy tool of hard metal in accordance with claim 9, wherein said thermal expansion coefficients of said working part and of said non-working part differ from each other within a range over $1\times10^{-7}$/°C. up to $3\times10^{-6}$/°C.

11. The alloy tool of hard metal of claim 1, wherein said diffused junction between said working part and said non-working part is formed by hot isostatic pressing.

* * * * *